US010068540B2

(12) United States Patent
Park et al.

(10) Patent No.: US 10,068,540 B2
(45) Date of Patent: Sep. 4, 2018

(54) CURVED LIQUID CRYSTAL DISPLAY WHICH PREVENTS EDGE STAIN

(71) Applicant: Samsung Display Co., Ltd., Yongin-Si, Gyeonggi-Do (KR)

(72) Inventors: Ki Soo Park, Hwaseong-si (KR); Wan-Soon Im, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 94 days.

(21) Appl. No.: 14/954,725

(22) Filed: Nov. 30, 2015

(65) Prior Publication Data

US 2016/0196779 A1 Jul. 7, 2016

(30) Foreign Application Priority Data

Jan. 5, 2015 (KR) ..... 10-2015-0000690

(51) Int. Cl.
*G09G 3/36* (2006.01)

(52) U.S. Cl.
CPC ..... *G09G 3/3648* (2013.01); *G09G 3/3607* (2013.01); *G09G 2300/0452* (2013.01); *G09G 2310/0232* (2013.01); *G09G 2320/0626* (2013.01); *G09G 2320/0673* (2013.01); *G09G 2320/0686* (2013.01)

(58) Field of Classification Search
CPC .. G09G 3/3644; G09G 3/3648; G09G 3/3607; G06F 1/161–1/162; G06F 1/1641; G06F 1/1652
USPC ..... 345/87
See application file for complete search history.

(56) References Cited

U.S. PATENT DOCUMENTS

2005/0280624 A1* 12/2005 Liu ..... G09G 3/3611 345/102
2009/0079681 A1* 3/2009 Chang ..... G02F 1/13336 345/88
2013/0135366 A1* 5/2013 Araki ..... G09G 3/3607 345/690
2013/0194494 A1* 8/2013 Chun ..... G09G 3/3233 348/453
2014/0168202 A1* 6/2014 Bae ..... G06F 1/1652 345/214
2015/0379944 A1* 12/2015 Chen ..... G09G 3/3607 345/694
2016/0057318 A1* 2/2016 Hsieh ..... G09G 3/36 345/690
2016/0205391 A1* 7/2016 Kim ..... G09G 3/3225 348/51

FOREIGN PATENT DOCUMENTS

JP 2006-258850 9/2006
KR 10-2005-0070193 7/2005
KR 10-2007-0100040 10/2007

* cited by examiner

*Primary Examiner* — Adam J Snyder
(74) *Attorney, Agent, or Firm* — Innovation Counsel LLP

(57) ABSTRACT

A liquid crystal display (LCD) includes: a curved liquid crystal panel; and a driving device for displaying an image by operating the curved liquid crystal panel, wherein a luminance curve for a gray level for generating a gray-level voltage to be applied by the driving device to a first color pixel disposed in an edge portion of the curved liquid crystal panel is disposed below a luminance curve for a gray level for generating a gray-level voltage to be applied to the first color pixel disposed in a remaining portion of the curved liquid crystal panel.

20 Claims, 7 Drawing Sheets

CURVED LIQUID CRYSTAL DISPLAY WHICH PREVENTS EDGE STAIN

CROSS-REFERENCE TO RELATED APPLICATION

This application claims priority to and the benefit of Korean Patent Application No. 10-2015-0000690 filed in the Korean Intellectual Property Office on Jan. 5, 2015, the entire contents of which are incorporated herein by reference.

BACKGROUND (a) Technical Field

This disclosure relates to a curved liquid crystal display (LCD).

(b) Description of the Related Art

Liquid crystal displays (LCDs) are currently the most widely used flat panel displays.

LCD includes two sheets of substrates formed with electrodes and a liquid crystal layer interposed therebetween. The LCD controls an amount of transmitted light by applying signals to the electrodes to realign liquid crystal molecules of the liquid crystal layer.

Recently, a curved LCD has been developed in order to enhance screen immersion.

The above information disclosed in this Background section is only for enhancement of understanding of the background of the inventive concept and therefore it may contain information that does not form the prior art.

SUMMARY

In a curved LCD, a defect such as edge stain causing an edge portion of a curved liquid crystal display to shine brighter than a center portion is recognized.

Such edge stain results from birefringence due to stress of glass in sealing portions at upper and lower long sides of a curved panel.

This can be seen from the fact that the edge stain appearing immediately after bending the panel does not change with the passage of time, and more edge stain is generated as the panel is further bent.

The present inventive concept has been made in an effort to solve the problem of the edge stain.

A liquid crystal display (LCD) according to an exemplary embodiment of the present inventive concept includes: a curved liquid crystal panel; and a driving device for displaying an image by operating the curved liquid crystal panel, wherein a luminance curve for a gray level for generating a gray-level voltage to be applied by the driving device to a first color pixel disposed in an edge portion of the curved liquid crystal panel is disposed below a luminance curve for a gray level for generating a gray-level voltage to be applied to the first color pixel disposed in a remaining portion of the curved liquid crystal panel.

The first color pixel may be a white pixel.

Luminance according to the gray-level voltage to be applied by the driving device to the first color pixel disposed in the edge portion of the curved liquid crystal panel may be decided by multiplying the luminance according to the gray-level voltage to be applied to the first color pixel disposed in the remaining portion of the curved liquid crystal panel by a value between 0 and 1. The value may be from about 0.75 to about 0.85. The value may be about 0.8. A gamma curve for the gray-level voltage to be applied by the driving device to the first color pixel disposed in the edge portion of the curved liquid crystal panel may be disposed below a gamma curve for the gray-level voltage to be applied to the first color pixel disposed in the remaining portion of the curved liquid crystal panel.

The curved liquid crystal panel may further include red, green, and blue pixels, and the red pixel, the green pixel, the blue pixel, and the white pixel are disposed in a 2×2 matrix.

For the same gray level, a gray-level voltage to be applied by the driving device to the first color pixel disposed in the edge portion of the curved liquid crystal panel may be lower than a gray-level voltage to be applied to the first color pixel disposed in the remaining portion of the curved liquid crystal panel.

The edge portion of the curved liquid crystal panel may include first, second, third, and fourth side portions, and for the same gray level, a gray-level voltage to be applied by the driving device to the first color pixel disposed adjacent to the first side portion may be lower than a gray-level voltage to be applied to the first color pixel disposed adjacent to at least one of the second, third, and fourth side portions.

For the same gray level, gray-level voltages to be applied by the driving device to the first color pixel disposed in the first, second, third, and fourth side portions may be different.

The driving device may include: a gate driver for applying a gate signal to the curved liquid crystal panel; a data driver for applying a data signal to the curved liquid crystal panel; a gray-level voltage generator for providing gray-level voltages as the data signal to the data driver; and a signal controller for generating signals to control the gate driver, the data driver, and the gray-level voltage generator.

The gray-level voltage generator may receive data received from an external device, and generate respective image data for data of the edge portion and data of the remaining portion using different luminance curves for gray levels to output them to the data driver.

The edge portion of the curved liquid crystal panel is a potion located within from about 30 to about 50 pixels from a respective edge of the curved liquid crystal panel.

According to the exemplary embodiment of the present inventive concept, the gray-level voltages applied to the edge portion of the curved LCD can be generated such that they are lower than the gray-level voltages applied to the other portion by the predetermined ratio or by using the lower gamma curves, thereby preventing the edge stain from being generated.

DETAILED DESCRIPTION OF THE EMBODIMENTS

The present inventive concept will be described more fully hereinafter with reference to the accompanying drawings, in which exemplary embodiments of the inventive concept are shown.

As those skilled in the art would realize, the described embodiments may be modified in various different ways, all without departing from the spirit or scope of the present inventive concept.

A curved liquid crystal display (LCD) according to an exemplary embodiment of the present inventive concept and a driving method thereof will now be described in detail with reference to the drawings.

First, a curved LCD according to an exemplary embodiment of the present inventive concept will be described with reference to FIGS. 1 to 5.

Figure 1:
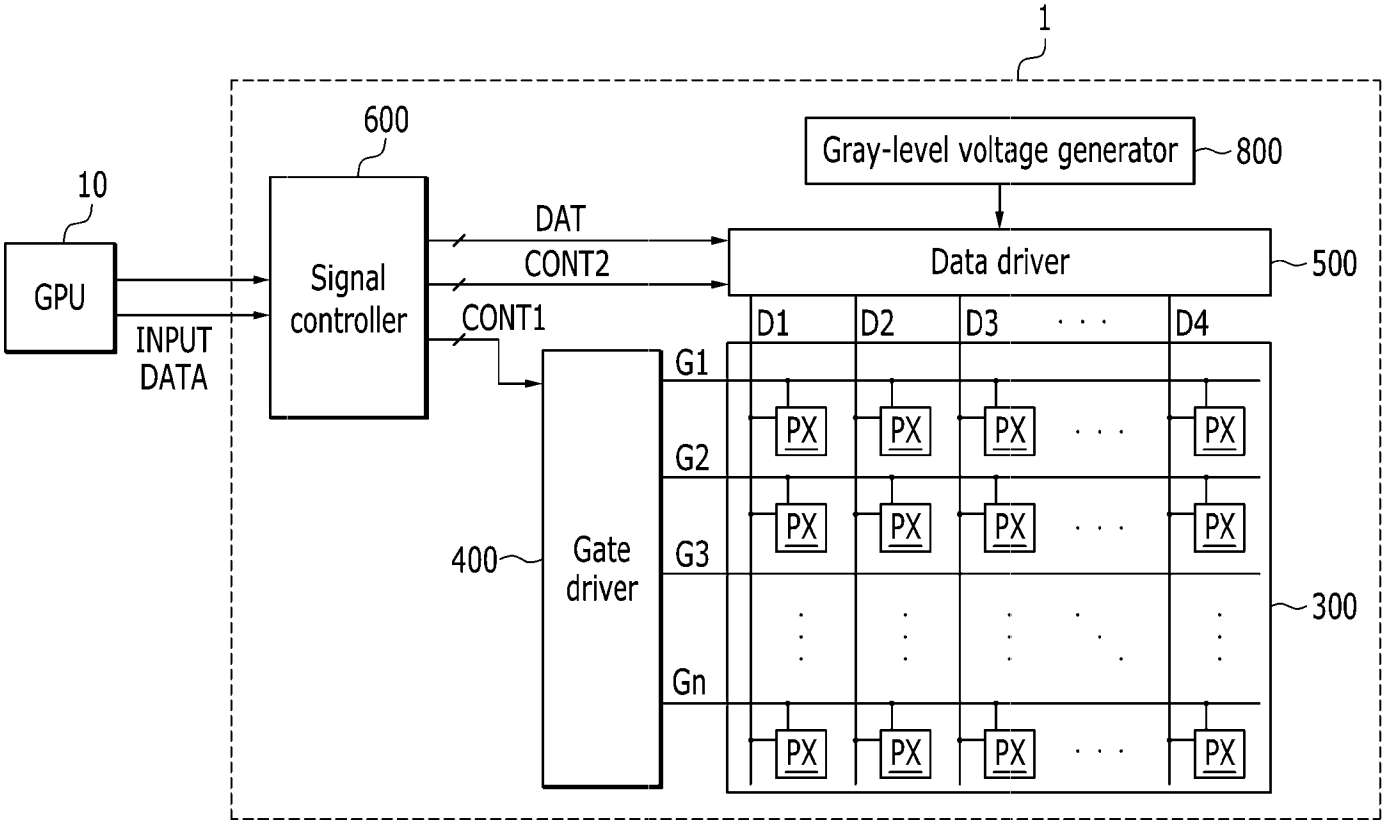
FIG. 1 is a block diagram of a liquid crystal display according to an exemplary embodiment of the present inventive concept.
Figure 2:
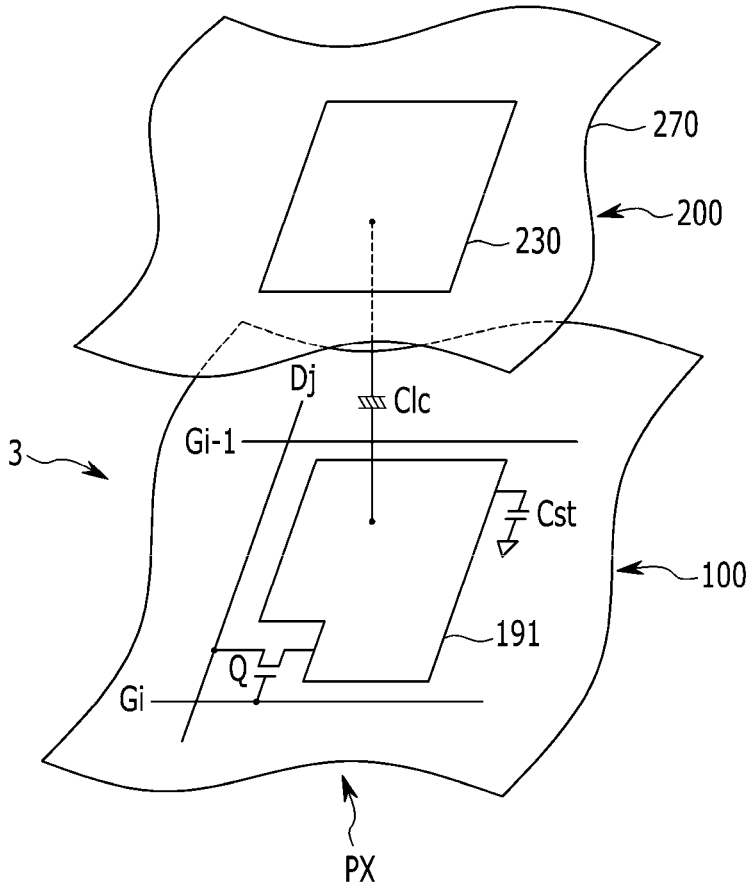
FIG. 2 is an equivalent circuit diagram of one pixel in the LCD according to the exemplary embodiment of the present inventive concept.
Figure 3:
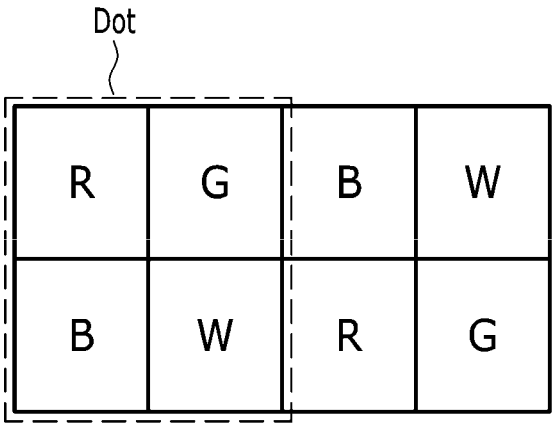
FIG. 3 is a layout view of pixels of the LCD according to the exemplary embodiment of the present inventive concept.
Figure 4:
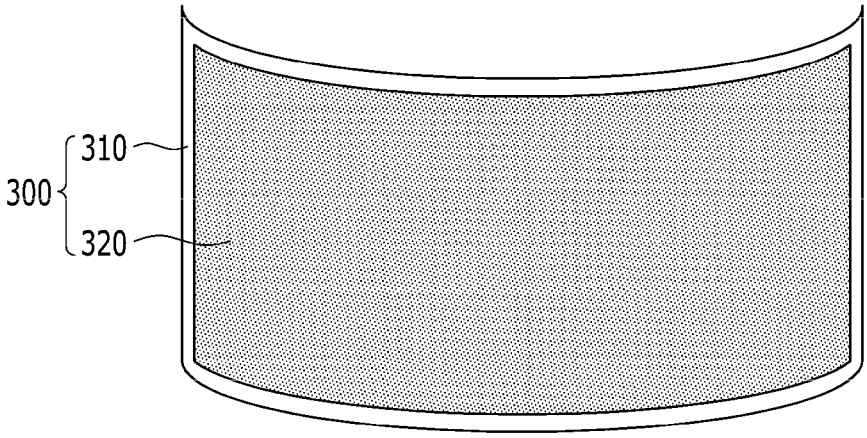
FIG. 4 is a layout view of the curved LCD according to the exemplary embodiment of the present inventive concept marked with an area where gray-level correction is made.
Figure 5:
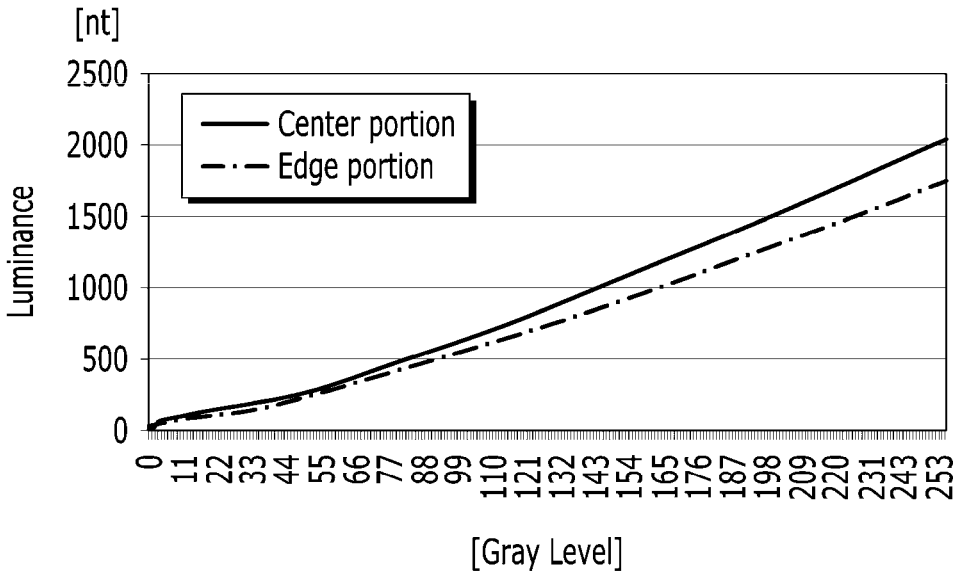
FIG. 5 illustrates luminance curves according to gray levels used in the curved LCD according to the exemplary embodiment of the present inventive concept.

FIG. 1 is a block diagram of a liquid crystal display according to an exemplary embodiment of the present inventive concept, FIG. 2 is an equivalent circuit diagram of one pixel in the LCD according to the exemplary embodiment of the present inventive concept, FIG. 3 is a layout view of pixels of the LCD according to the exemplary embodiment of the present inventive concept, FIG. 4 is a layout view of the curved LCD according to the exemplary embodiment of the present inventive concept marked with an area where gray-level correction is made, and FIG. 5 illustrates luminance curves according to gray levels used in the curved LCD according to the exemplary embodiment of the present inventive concept.

As shown in FIG. 1, the LCD 1 includes a liquid crystal panel 300 for displaying an image, a gate driver 400, a data driver 500, a signal controller 600, and a gray-level voltage generator 800.

A graphics processing unit (GPU) 10 disposed outside of the LCD 1 is also illustrated in FIG. 1.

The graphics processing unit 10 may provide input data for displaying an image to the LCD 1.

After receiving the input data from the GPU 10, the LCD 1 operates to display the image according to the input data.

In this case, referring to FIG. 4, the display panel 300 may include an edge portion 310 and a remaining portion 320 (a center portion surrounded by the edge portion), and image data for the edge portion 310 may be generated based on different criteria from that for the remaining portion 320.

In other words, the signal controller 600 divides the input data into data of the edge portion 310 and data of the remaining portion 320, and converts them into the image data to be transmitted to the data driver 500 by applying different reference gray-level voltages for the data of the edge portion 310 from those for the data of the remaining portion 320.

In this case, the reference gray-level voltages applied to the data of the edge portion 310 represent lower luminance than those applied to the remaining portion 320 by a predetermined ratio. The lower luminance is decided by multiplying the luminance according to the gray-level voltage to be applied to the first color pixel disposed in the remaining portion of the curved liquid crystal panel by a value between 0 and 1. The value may be from about 0.75 to about 0.85. The value may be about 0.8.

For example, if a gray-level voltage corresponding to brightness of 2,000 nt (Nit) represents a 255 gray-level in the remaining portion 320, a gray-level voltage corresponding to brightness of 1,600 nt may represent the same gray level in the edge portion 310. (1 nt=1 cd/$m^2$)

In a normally black mode LCD, since luminance increases as the gray-level voltages increases, the reference gray-level voltages applied to the data of the edge portion 310 are lower than those applied to the remaining portion 320.

In this case, lower reference gray-level voltages than those applied to the remaining portion 320 may be applied to generate data for all pixels of the edge portion 310, or lower reference gray-level voltages than those applied to the remaining portion 320 may be applied to data for some pixels, for example, white pixels of the edge portion 310.

Each component of the LCD 1 will now be described in detail with reference to FIGS. 1 and 2.

The liquid crystal panel 300 includes lower and upper panels 100 and 200 facing each other, and a liquid crystal layer 3 interposed therebetween.

The liquid crystal panel 300 includes a plurality of gate lines G1 to Gn and a plurality of data lines D1 to Dm.

The plurality of gate lines G1 to Gn substantially extend in a horizontal direction, and the plurality of data lines D1 to Dm substantially extend in a vertical direction while being insulated from and crossing the plurality of gate lines G1 to Gn.

One of the gate lines G1 to Gn and one of the data lines D1 to Dm are connected to one pixel PX.

These pixels PXs are arranged in a matrix form, and each pixel PX may include a thin film transistor Q, a liquid crystal capacitor Clc, and a storage capacitor Cst.

A control terminal of the thin film transistor Q may be connected to one of the gate lines G1 to Gn, an input terminal of the thin film transistor Q may be connected to one of the data lines D1 to Dm, and an output terminal of the thin film transistor Q may be connected to a pixel electrode 191, which is one terminal of the liquid crystal capacitor Clc, and one terminal of the storage capacitor Cst.

The other terminal of the liquid crystal capacitor Clc may be connected to a common electrode 270, and the other terminal of the storage capacitor Cst may be applied with a storage voltage.

In the exemplary embodiment of the present inventive concept, the liquid crystal panel 300 may be a plane-to-line switching (PLS) type, and in this case, both the pixel electrode 191 and the common electrode 270 are formed to be disposed in the lower panel 100.

In some exemplary embodiments, one row of pixels PXs may be alternately connected to a pair of gate lines those are disposed above and below the pixel row.

That is, the gate lines G1 to Gn may be alternately connected to the pixels that are disposed above and below the gate lines G1 to Gn, respectively.

According to the structure described above, odd-numbered pixels and even-numbered pixels included in one pixel row may be connected to the different gate lines.

In this case, the data lines D1 to Dm are respectively connected to the pixels that are disposed along one column.

Referring to FIG. 3, the liquid crystal panel 300 according to the exemplary embodiment of the present inventive concept includes red, green, blue, and white pixels R, G, B, and W, and the red, green, blue, and white pixels R, G, B, and W are disposed in a 2×2 matrix to represent one dot.

In addition, orders of arranging the red, green, blue, and white pixels R, G, B, and W are different from one another in two adjacent dots.

The signal controller 600 appropriately processes input data and control signals those are received from the outside, for example, a vertical synchronization signal Vsync, a horizontal synchronization signal Hsync, a main clock signal MCLK, a data enable signal DE, and the like in accordance with operating conditions of the liquid crystal panel 300, and generates and then outputs image data DAT, a gate control signal CONT1, a data control signal CONT2, and a clock signal.

Referring to FIG. 5, for the same gray level, the image data DAT represents lower luminance in the edge portion 310 than in the remaining portion (center portion) by a predetermined ratio.

In this case, the image data DAT for all the pixels of the edge portion 310 may be set to represent lower luminance than that for all the pixels of the remaining portion by the predetermined ratio, and only some pixels, for example, white pixels of the edge portion 310, may be set to represent lower luminance than the pixels of the remaining portion.

The gate control signal CONT1 includes a start pulse vertical signal STV for instructing a scan start, and a clock pulse vertical signal CPV serving as a reference for generating a gate-on voltage Von.

An output period of the start pulse vertical signal STV corresponds to one frame (or refresh rate).

In addition, the gate control signal CONT1 may further include an output enable signal OE for limiting duration of the gate-on voltage Von.

The data control signal CONT2 includes a start pulse horizontal signal STH for instructing a transmission start of the image data DAT for one row of pixels, a load signal TP for applying a corresponding data voltage to the data lines D1 to Dm, and the like.

The data control signal CONT2 may further include a reverse signal RVS for reversing polarities of the data voltage with respect to a common voltage Vcom.

The signal controller 600 may use the gate control signal CONT1 and the data control signal CONT2 to allow the gate driver 400 and the data driver 500 to display the image corresponding to the input data on the liquid crystal panel 300.

The plurality of gate lines G1 to Gn of the liquid crystal panel 300 are connected to the gate driver 400 and are sequentially applied with the gate-on voltage Von according to the gate control signal CONT1 applied from the signal controller 600, and are applied with the gate-off voltage Voff when the gate-on voltage Von is not applied.

The plurality of data lines D1 to Dm of the liquid crystal panel 300 are connected to the data driver 500, and the data driver 500 receives the data control signal CONT2 and the image data DAT from the signal controller 600.

Using the gray-level voltages generated from the gray-level voltage generator 800, the data driver 500 converts the image data DAT into the data voltage to transmit it to the data lines D1 to Dm.

The data voltage includes a data voltage of positive polarity and a data voltage of negative polarity.

For polarity inversion driving, the data voltage of positive polarity and the data voltage of negative polarity are alternately applied to each of frames, rows, and/or columns.

As described above, when the liquid crystal panel 300 is divided into the edge portion 310 and the remaining portion 320, and the image data for at least one of the pixels (e.g., the white pixel) of the edge portion 310 is set to represent the lower luminance than the image data for the remaining portion 320, edge stain causing the edge portion 310 of the curved LCD to shine brighter than the center portion can be prevented from being generated.

Among the pixels of the edge portion 310, only the white pixels may be set to represent the lower luminance. This is because color coordinates may vary if luminance for red, green, and blue pixels is adjusted, and the overall luminance is mainly determined by the white pixels so the edge stain can be prevented by adjusting only the white pixels.

In the above exemplary embodiment, as shown in FIG. 5, the reference gray-level voltages applied to the data of the edge portion 310 are adjusted to represent the lower luminance than those applied to the remaining portion 320 by the predetermined ratio.

Alternatively, different gamma curves for the reference gray-level voltages may be applied.

Figure 6:
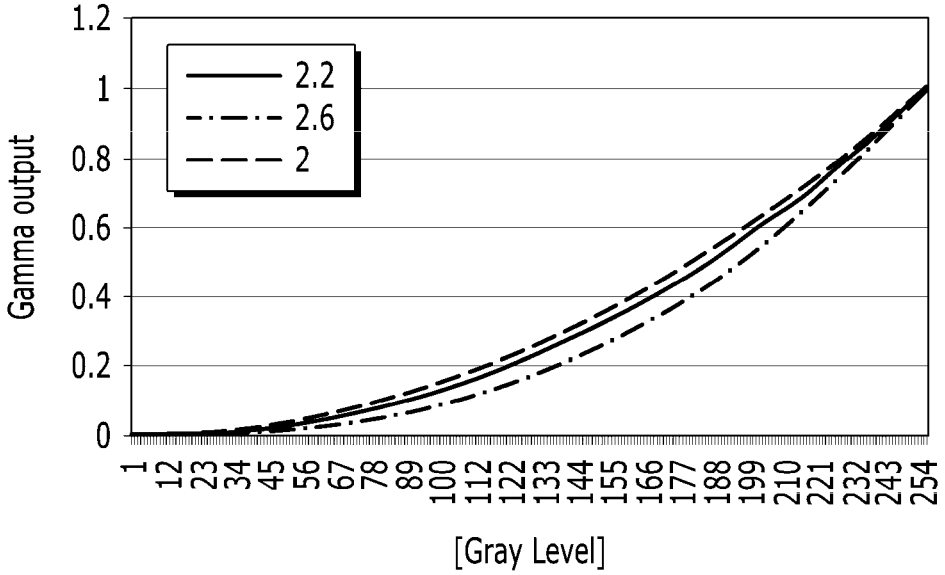
FIG. 6 illustrates gamma curves used in the curved LCD according to the exemplary embodiment of the present inventive concept.

FIG. 6 illustrates gamma curves used in the curved LCD according to the exemplary embodiment of the present inventive concept.

Referring to FIG. 6, the general LCD uses a gamma 2.2 curve that is marked with a solid line.

Accordingly, the gray-level voltages of the image data for the remaining portion 320 are generated based on the gamma 2.2 curve, and the gray-level voltages of the image data for at least one of the pixels (e.g., the white pixel) of the edge portion 310 are generated based on a gamma 2.6 curve that is marked with an alternating long and short dashed line, thereby preventing generation of the edge stain causing the edge portion 310 of the curved LCD to shine brighter than the center portion.

Alternately, the gray-level voltages of the image data for the remaining portion 320 are generated based on a gamma 2 curve that is marked with a dashed line, and the gray-level voltages of the image data for at least one of the pixels of the edge portion 310 (e.g., white pixel) may be generated based on the gamma 2.2 curve marked with the solid line or the gamma 2.6 curve marked with an alternating long and short dashed line.

As such, when the different gamma curves are applied, the edge stain may occur near the highest gray level (255 gray level) since no luminance reduction is achieved in the edge portion 310, but when displaying the general image, prevention of the edge stain can be sufficiently achieved since there is little chance of displaying the image corresponding to the highest gray level.

Until now, the case in which the luminance of the entire edge portion 310 is uniformly adjusted has been exemplarily described, but the edge portion 310 may be subdivided to provide various degrees of luminance adjustments.

Figure 7:
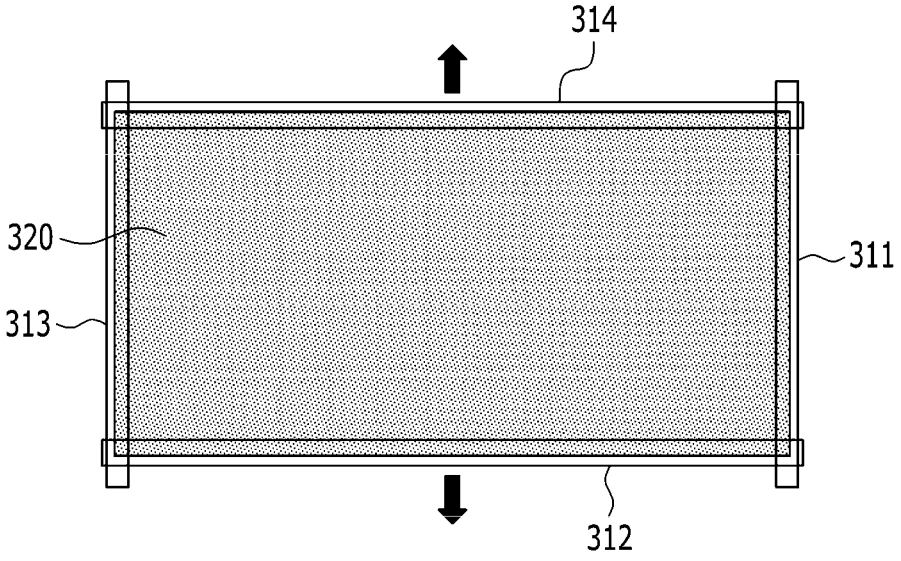
FIG. 7 is a layout view of a curved LCD according to another exemplary embodiment of the present inventive concept marked with areas where gray-level correction is made.

FIG. 7 is a layout view of a curved LCD according to another exemplary embodiment of the present inventive concept marked with areas where gray-level correction is made.

Referring to FIG. 7, the edge portion may be divided into a right side portion 311, a lower side portion 312, a left side portion 313, and an upper side portion 314, and reference gray-level voltages applied to the respective portions may be different depending on how much edge stain is generated.

For example, if a 255 gray level corresponds to a gray-level voltage corresponding to brightness of 20,000 nt in a remaining portion 320, the 255 gray level corresponds to a gray-level voltage corresponding to brightness of 16,000 nt in the right side portion 311, the 255 gray level corresponds to a gray-level voltage corresponding to brightness of 17,000 nt in the lower side portion 312, the 255 gray level corresponds to a gray-level voltage corresponding to brightness of 18,000 nt in the upper side portion 314, and the 255 gray level corresponds to a gray-level voltage corresponding to brightness of 20,000 nt in the left side portion 313 as in the remaining portion 320.

In the above description, the edge portion 310 may be a portion located within from about 30 to about 50 pixels from the respective edge of the liquid crystal panel.

While this inventive concept has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. A liquid crystal display (LCD) comprising:

a curved liquid crystal panel which is bent to have a concave surface, the curved liquid crystal panel having an edge portion including pixels and a remaining portion including pixels, the edge portion completely surrounding the remaining portion; and a driving device for displaying an image by operating the curved liquid crystal panel, wherein the curved liquid crystal panel includes red, green, blue, and white pixels, and wherein a luminance curve for a gray level for generating a gray-level voltage to be applied by the driving device to the white pixel disposed in the edge portion of the curved liquid crystal panel is disposed below a luminance curve for a gray level for generating a gray-level voltage to be applied to the white pixel disposed in the remaining portion of the curved liquid crystal panel.

2. The LCD of claim 1, wherein luminance according to the gray-level voltage to be applied by the driving device to the white pixel disposed in the edge portion of the curved liquid crystal panel is decided by multiplying the luminance according to the gray-level voltage to be applied to the white pixel disposed in the remaining portion of the curved liquid crystal panel by a value between 0 and 1.

3. The LCD of claim 2, wherein the value is from about 0.75 to about 0.85.

4. The LCD of claim 3, wherein the value is about 0.8.

5. The LCD of claim 1, wherein a gamma curve for the gray-level voltage to be applied by the driving device to the white pixel disposed in the edge portion of the curved liquid crystal panel is disposed below a gamma curve for the gray-level voltage to be applied to the white pixel disposed in the remaining portion of the curved liquid crystal panel.

6. The LCD of claim 1, wherein the red pixel, the green pixel, the blue pixel, and the white pixel are disposed in a 2×2 matrix.

7. The LCD of claim 1, wherein, for the same gray level, a gray-level voltage to be applied by the driving device to the white pixel disposed in the edge portion of the curved liquid crystal panel is lower than a gray-level voltage to be applied to the white pixel disposed in the remaining portion of the curved liquid crystal panel.

8. The LCD of claim 7, wherein the edge portion of the curved liquid crystal panel includes first, second, third, and fourth side portions, the first, second, third, and fourth side portions being formed along edge portions of the curved liquid crystal panel to surround the remaining portion, and, for the same gray level, a gray-level voltage to be applied by the driving device to the white pixel disposed adjacent to the first side portion is lower than a gray-level voltage to be applied to the white pixel disposed adjacent to at least one of the second, third, and fourth side portions.

9. The LCD of claim 8, wherein, for the same gray level, gray-level voltages to be applied by the driving device to the white pixel disposed in the first second, third, and fourth side portions are different.

10. The LCD of claim 1, wherein the driving device includes: a gate driver for applying a gate signal to the curved liquid crystal panel; a data driver for applying a data signal to the curved liquid crystal panel; a gray-level voltage generator for providing gray-level voltages as the data signal to the data driver; and a signal controller for generating signals to control the gate driver, the data driver, and the gray-level voltage generator.

11. The LCD of claim 10, wherein the gray-level voltage generator receives data received from an external device, and generates respective image data for data of the edge portion and data of the remaining portion using different luminance curves for gray levels to output them to the data driver.

12. The LCD of claim 1, wherein the edge portion of the curved liquid crystal panel is a potion located within from about 30 to about 50 pixels from a respective edge of the curved liquid crystal panel.

13. The LCD of claim 1, wherein a gamma curve for the gray-level voltage to be applied by the driving device to the white pixel disposed in the edge portion of the curved liquid crystal panel is disposed below a gamma curve for the gray-level voltage to be applied to a white pixel disposed in the remaining portion of the curved liquid crystal panel.

14. A liquid crystal display (LCD) comprising:

a curved liquid crystal panel which is bent to have a concave surface, the curved liquid crystal panel having an edge portion including pixels and a remaining portion including pixels, the edge portion completely surrounding the remaining portion; and a driving device for displaying an image by operating the curved liquid crystal panel, wherein a luminance curve for a gray level for generating a gray-level voltage to be applied by the driving device to a first color pixel disposed in the edge portion of the curved liquid crystal panel is disposed below a luminance curve for a gray level for generating a gray-level voltage to be applied to the first color pixel disposed in the remaining portion of the curved liquid crystal panel.

15. The LCD of claim 14, wherein the first color pixel is a white pixel.

16. The LCD of claim 15, wherein luminance according to the gray-level voltage to be applied by the driving device to the first color pixel disposed in the edge portion of the curved liquid crystal panel is decided by multiplying the luminance according to the gray-level voltage to be applied to the first color pixel disposed in the remaining portion of the curved liquid crystal panel by a value between 0 and 1.

17. The LCD of claim 16, wherein the value is from about 0.75 to about 0.85.

18. The LCD of claim 17, wherein the value is about 0.8.

19. The LCD of claim 15, wherein a gamma curve for the gray-level voltage to be applied by the driving device to the first color pixel disposed in the edge portion of the curved liquid crystal panel is disposed below a gamma curve for the gray-level voltage to be applied to the first color pixel disposed in the remaining portion of the curved liquid crystal panel.

20. The LCD of claim 15, wherein the curved liquid crystal panel further includes red, green, and blue pixels, and the red pixel, the green pixel, the blue pixel, and the white pixel are disposed in a 2×2 matrix.

* * * * *